US005232352A

United States Patent [19]

Robinson

[11] Patent Number: 5,232,352

[45] Date of Patent: Aug. 3, 1993

[54] FLUID ACTIVATED DOUBLE DIAPHRAGM PUMP

[75] Inventor: Ronald L. Robinson, Windham, Ohio

[73] Assignee: Holcomb Corporation, Akron, Ohio

[21] Appl. No.: 863,749

[22] Filed: Apr. 6, 1992

[51] Int. Cl.[5] ..... F04B 43/06

[52] U.S. Cl. ..... 417/393; 91/309; 91/329; 91/345

[58] Field of Search ..... 417/393; 91/309, 311, 91/329, 345

[56] References Cited

U.S. PATENT DOCUMENTS

| | | | |
|---|---|---|---|
| 3,548,716 | 12/1970 | Rayl | 91/329 |
| 3,652,187 | 3/1972 | Loeffler et al. | 417/393 |
| 3,791,768 | 2/1974 | Wanner | 417/393 |
| 4,104,008 | 8/1978 | Hoffman et al. | 417/397 |
| 4,247,264 | 1/1981 | Wilden | 417/393 |
| 4,339,985 | 7/1982 | Wilden | 91/329 |
| 4,478,560 | 10/1984 | Rupp | 417/393 |
| 4,548,551 | 10/1985 | Ruttenberg et al. | 417/393 |
| 4,854,832 | 8/1989 | Gardner et al. | 417/393 |

*Primary Examiner*—Richard A. Bertsch
*Assistant Examiner*—Peter Korytnyk
*Attorney, Agent, or Firm*—Reese Taylor

[57] ABSTRACT

A double diaphragm pump includes a connecting shaft for interconnecting the opposed diaphragms mounted in the pump body for reciprocal movement relatively thereof and a pilot valve sleeve telescoped over the shaft and movable axially in response to movement of the connecting shaft and having a plurality of axially directed circumferentially disposed recesses thereon for fluid transfer through the pilot valve cavity. A spool valve assembly is also carried by the body in a cavity which is in selected fluid communication with a source of air pressure, the pilot valve, the atmosphere and the pressure chambers of the pump. The pilot valve sleeve also has at least one projecting annular rib which engages the usual O-rings of the cavity in which the connecting rods and pilot valve sleeve reciprocate for assisting movement past the O-rings in response to pressure from the spool valve.

17 Claims, 4 Drawing Sheets

FLUID ACTIVATED DOUBLE DIAPHRAGM PUMP

BACKGROUND OF THE INVENTION

This invention relates in general to double diaphragm, fluid actuated pumps and relates in particular to an improved valving arrangement therefor.

DESCRIPTION OF THE PRIOR ART

It is known in the prior art to transfer viscous liquids by the use of a double diaphragm pump. Such pumps typically comprise a housing which includes a pair of pumping chambers capable of being connected to inlet and outlet lines and a pair of associated pressure chambers separated from the pumping chambers by flexible diaphragms. Valve means are usually carried by the housing to transfer pressure from one side to the other as the pump operates.

In operation, as one pressure chamber is pressurized, its associated diaphragm is flexed to compress fluid in the associated pumping chamber. The fluid is thus forced from the pumping chamber to the associated outlet line. Simultaneously, the opposed diaphragm associated with the other pumping chamber is flexed in the opposite direction so as to draw fluid material into the second pumping chamber from the associated inlet line.

These pumps thus operate by reciprocating the diaphragms, which move in unison, to alternatively fill and evacuate pumping chambers and thus pump the viscous liquids.

Examples of typical pumps known to this art can be seen in Wanner U.S. Pat. No. 3,791,768; Hoffmann U.S. Pat. No. 4,104,008; Wilden U.S. Pat. No. 4,247,264; Rupp U.S. Pat. No. 4,478,560; Ruttenberg U.S. Pat. No. 4,548,551; and Gardner U.S. Pat. No. 4,854,832.

While these pumps are generally satisfactory for the purposes for which they are designed, one specific difficulty is often encountered. Thus, inasmuch as these pumps are intended to operate on a continuous basis at various speeds, it is possible, especially at low cycle speeds, for the pump to stall or hesitate in the middle of the transition from the one side to the other. That is, just as the diaphragms are ready to shift directions, the activating air stream would often be split and the valve may lock up for lack of sufficient force to move it and enable the desired continuous operation to proceed. This is, of course, very undesirable and various attempts have been made to resolve the problem.

Specifically, for example, the Gardner patent mentioned above discloses a combined mechanical shifting mechanism and pneumatic pilot valve construction intended to control the cycling in which the pilot member is engaged by the diaphragms as they flex from one side to the other. It has been found in practice, however, that even this mechanism, which is intended to avoid the aforementioned difficulty, does not always completely solve the problem.

Therefore, while the prior art mentioned herein is, as previously noted, essentially effective for the purposes for which it is designed, it is believed that further improvements can be made thereon.

SUMMARY OF THE INVENTION

It is, accordingly, the principal object of this invention to provide a fluid activated, double diaphragm pump capable of continuous reciprocating action to pump viscous fluid with the elimination of any tendency to stall, particularly at low operating speeds.

In accordance with that principal, it has been found that the usual shaft which mechanically interconnects the diaphragms can be combined with the pilot valve to simplify construction and assembly and enhance performance.

It has also been found, in accordance with that object, that movement through the transition stage by the pilot valve can be further enhanced by providing a sharp, annular projection on the pilot valve which, in cooperation with the O-ring seals, serves to act as a spring to propel the valve in the desired direction and insure uninterrupted operation.

Accordingly, production of such a pump becomes the principal object of this invention with other objects thereof becoming more apparent upon a reading of the following brief specification considered and interpreted in view of the drawings.

BRIEF DESCRIPTION OF THE PREFERRED EMBODIMENTS

Figure 1:
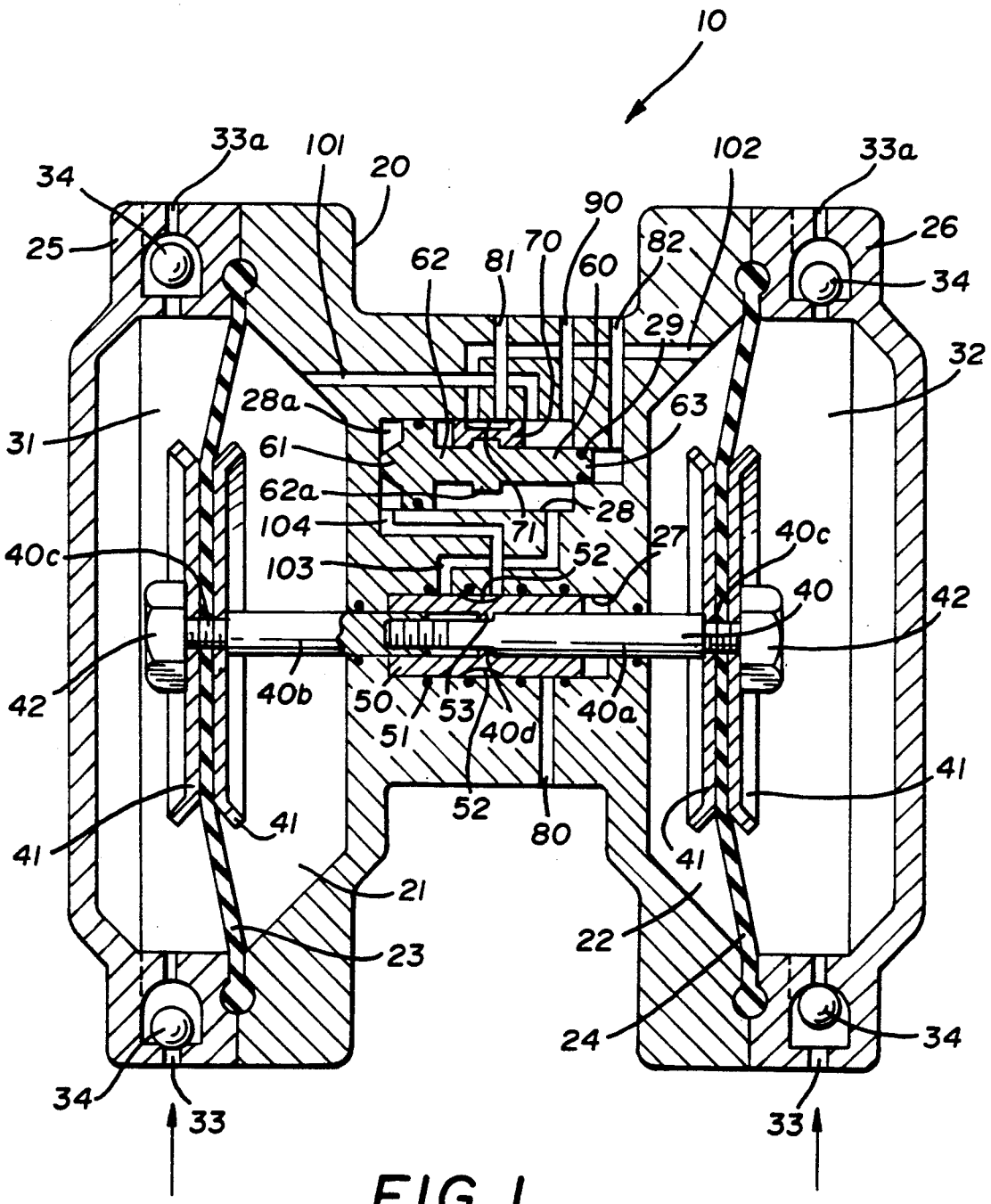
FIG. 1 is a schematic, cross-sectional view of the improved valve of the present invention in one pumping position.

It will be noted from FIG. 1 that the pump of the present invention, generally indicated by the numeral 10, has been described as being illustrated in one pumping position. It will be understood that, during operation, the pump would be operated continuously and continuously reciprocating from left to right and vice versa of the drawings.

With that in mind, and still referring to FIG. 1, it will be seen that the improved pump includes a main body or housing 20, which may be of multi-part construction, which has an interior cavity or first pressure chamber 21 and a second interior cavity or second pressure chamber 22. The pressure chambers 21 and 22 are closed off by first and second flexible diaphragms 23 and 24, respectively.

The flexible diaphragms 23 and 24 are held in place by first and second closure members 25 and 26, respectively, which can be secured to housing 20 in known fashion. The effect then is to create a first pumping chamber 31 between the first diaphragm 23 and the first closure member 25 and a second pumping chamber 32 between the second diaphragm 24 and the second closure member 26.

It will also be noted that the first and second closure members 25 and 26 are provided with inlet and outlet ports 33,33 and **33*a*,33*a*, respectively, and ball valves 34,34**, the operation of which will be described below with ports 33,33 and 33a,33a being adapted to be connected to inlet and outlet lines.

Still referring to FIG. 1 of the drawings, it will be noted that the first and second diaphragms 23 and 24 are mechanically interconnected by a two-piece connecting shaft 40 which has a first body portion 40a and a second body portion 40b and opposed, reduced diameter threaded ends 40c,40c. The portions 40a and 40b are illustrated as being screwed together for ease of assembly. The shaft may also be unitary if desired, but in either event is axially slidable in housing 20.

Locating plates 41,41 are disposed on each side of each diaphragm 23,24 and receive the opposed ends 40c,40c of the connecting shaft 40 and are attached thereto by means of the bolts 42,42 so that axial movement of the connecting shaft will be simultaneous with and in response to movement of the diaphragms as will be described more fully below.

Still referring to FIG. 1 of the drawings, it will be seen that the pilot valve 50 takes the form of an elongate sleeve telescoped over the body of connecting shaft 40. This sleeve is received in a pilot valve cavity 27 in the main housing 20 of the pump and is axially reciprocal therein.

Figure 2:
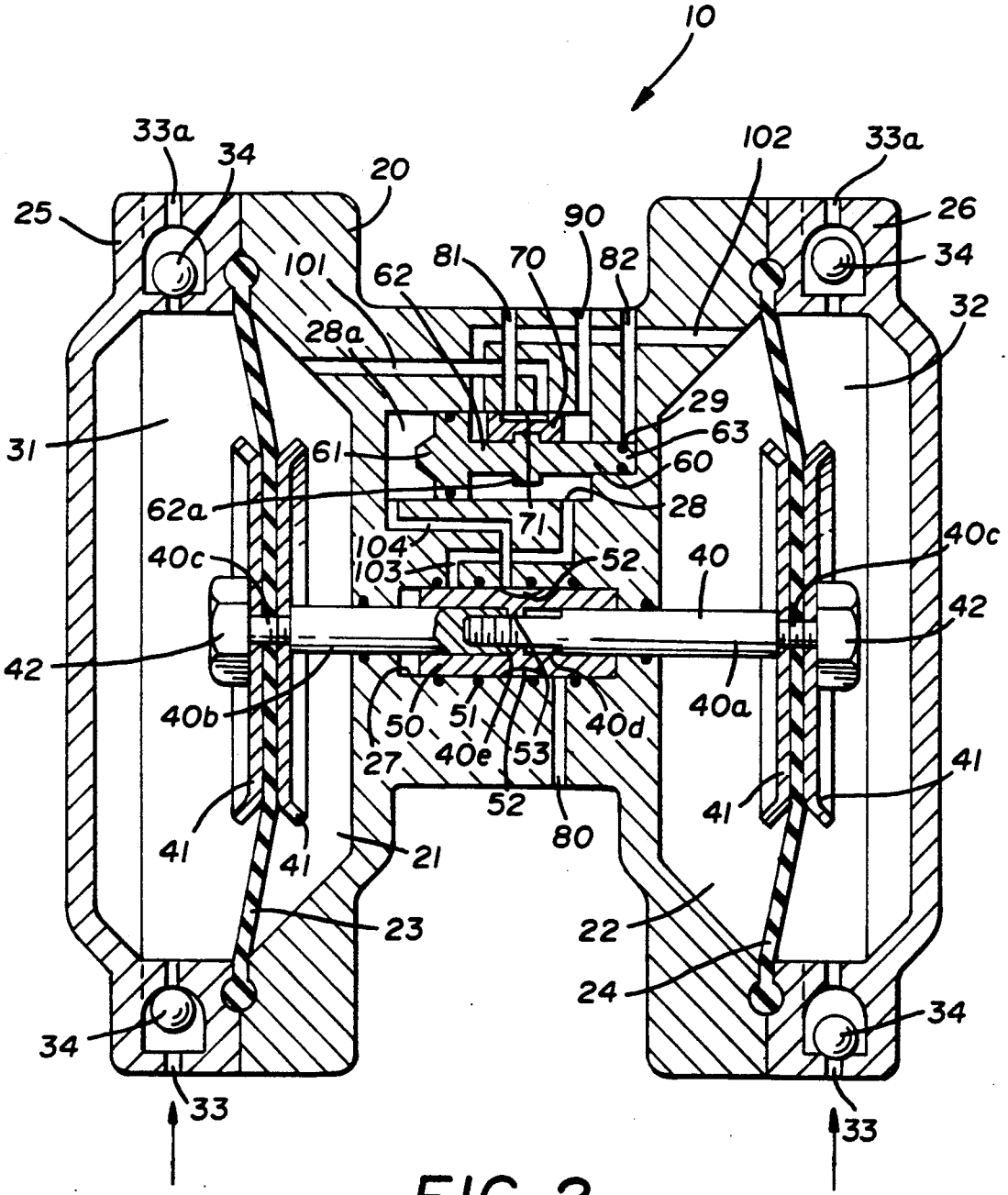
FIG. 2 is a view similar to FIG. 1 showing the pump moved to the second pumping position wherein fluid will be pumped from the first pumping chamber.
Figure 3:
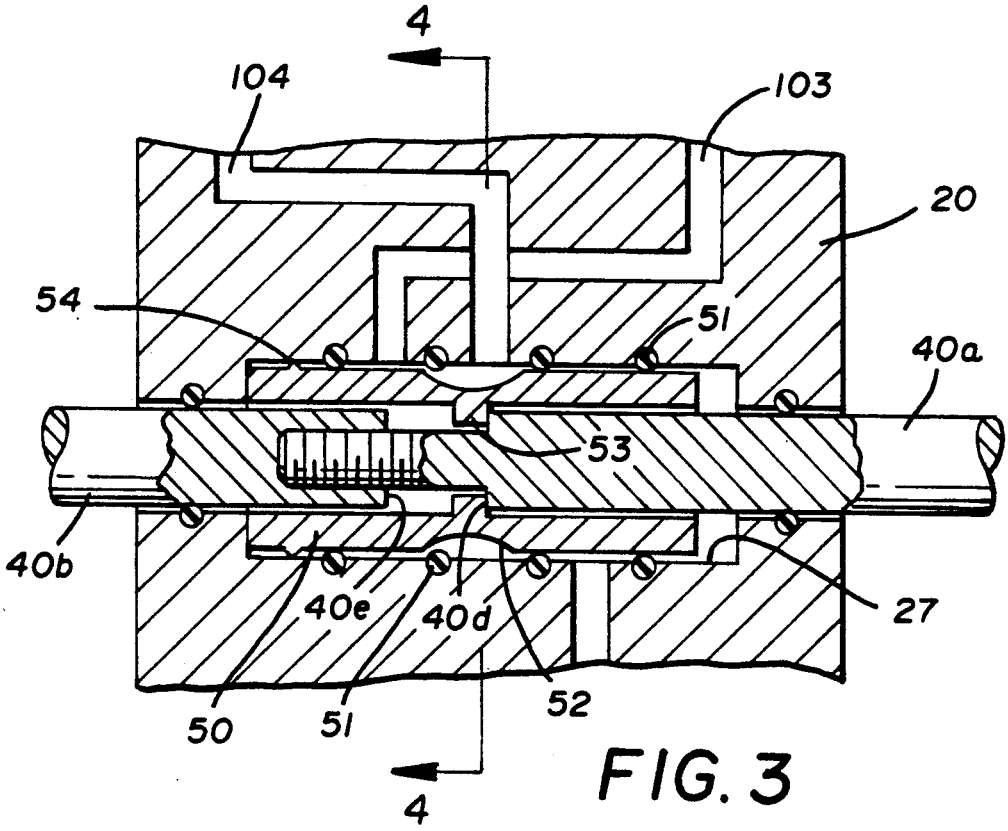
FIG. 3 is an enlarged view of the pilot valve and diaphragm operating apparatus.

The pilot valve 50 is supported on O-rings 51,51 disposed about the periphery of the pilot valve cavity 27 for sealing purposes. The pilot valve 50 also has a plurality of axially extending recesses 52 on its outer surface and a radially inwardly projecting circumferential ring 53 disposed at about its midpoint. It will be noted also that body portions 40a and 40b of the connecting shaft 40 terminate in end surfaces 40d and 40e so as to effectively form a central annular groove. The end surfaces 40d and 40e present shoulders which will engage the radial inwardly projecting circumferential ring 53 of the pilot valve 50 as shaft 40 moves from side to side, as will be described below and as can be seen in FIGS. 1, 2 and 3 of the drawings.

A spool valve cavity 28 is also provided in the main housing 20 and receives the spool valve 60. The spool valve 60 has a first enlarged end 61 dimensioned so as to slidingly engage the inner surface of the cavity 28, a central portion 62 with a circumferential rib 62a and a reduced diameter second end 63.

A slide valve 70 is also provided in the cavity 28 and is engagable with the circumferential rib 62a of portion 62 of the spool valve 60 so as to move in unison therewith as the spool valve moves axially within the cavity 28. The slide valve 70 also has a reduced area central portion 71 which has an axial extent sufficient to uncover two of the passages 81, 101 or 102 at any given time for purposes which will be described below.

It will also be noted that lip seals 29 are provided about the reduced diameter end 63 of the spool valve 60 for sealing purposes.

Still considering FIGS. 1 and 2 of the drawings, it will be noted that a number of exhaust passages 80, 81 and 82 are illustrated as being bored in housing 20 with the exhaust passage 80 communicating between the atmosphere and the pilot valve cavity 27 and shown sealed in FIG. 1 and the exhaust passages 81 and 82 communicating between the atmosphere and the spool valve cavity 28.

A main air supply passage 90 is provided in the main body or housing 20 for supply of the air or fluid utilized to operate the pump. This continuously supplies line pressure to cavity 28. A communicating supply passage 101 leads from the spool valve cavity 28 to the first pressure chamber 21 and a similar supply passage 102 leads from the spool valve cavity 28 to the second pressure chamber 22 so as to selectively supply pressurized fluid to those chambers. Furthermore, supply passages 103 and 104 interconnect the pilot valve cavity 27 and the spool valve cavity 28.

In use or operation of the improved pump, and assuming the pump to be just reaching the FIG. 1 position, the operating air or other fluid being supplied through the main supply passage 90 into the spool valve cavity 28 and, through passage 103, to the series of axial recesses 52 of pilot valve 50 then through passage 104 to area 28a formed between enlarged end 61 of spool valve 60 and the end of cavity 28 will force valve 60 to the right. This will move spool valve 60 to the right of FIG. 1. This permits pressurized air to exit the first pressure chamber 21 and begin to enter the second pressure chamber 22. This begins to collapse the diaphragm 23 from the position of FIG. 1 to the position of FIG. 2. It also, of course, begins to distort the diaphragm 24 to the FIG. 2 position.

As the connecting shaft 40 moves to the right, the shoulder 40e of the second shaft portion 40b will eventually engage the inwardly projecting annular ring 53 on the pilot valve 50 and the pilot valve 50 will then move in unison with the connecting shaft 40 from the FIG. 1 to the FIG. 2 position. At that time, it will be noted that the exhaust passage 80 is open and line 103 between the series of axial recesses 52 and cavity 28 is closed and the passage 104 is uncovered. This then permits the flow to be reversed wherein pressure is released through the passageway 104 to exhaust passage 80 and allows the pressure on the right-hand side of enlarged end 61 to cause it to move to the left. This reversal results in pressure exiting pressure chamber 22 through passage 102 and pressure entering pressure chamber 21 through passage 101. The flexing of the diaphragms 23,24 is then reversed, as illustrated in FIG. 1, thus expelling the material to be pumped through the pumping chamber 31 while drawing material into pumping chamber 32.

It will be noted that pressure is continuously supplied and there is thus little or no danger of cessation of operation or stalling.

It will be noted from FIG. 3 of the drawings that an annular projection 54 is disposed on the outer surface of pilot valve 50. This shape projection selectively engages one of the O-rings 51 and further insures that the pump will not stall. Thus, as the pilot valve 50 is moved in either direction, this projection engages a selected one of the resilient O-rings and tends to climb up one arcuate portion thereof and then spring past with the O-ring serving as a spring to supply the final amount of force to insure that the motion is uninterrupted.

Figure 4:
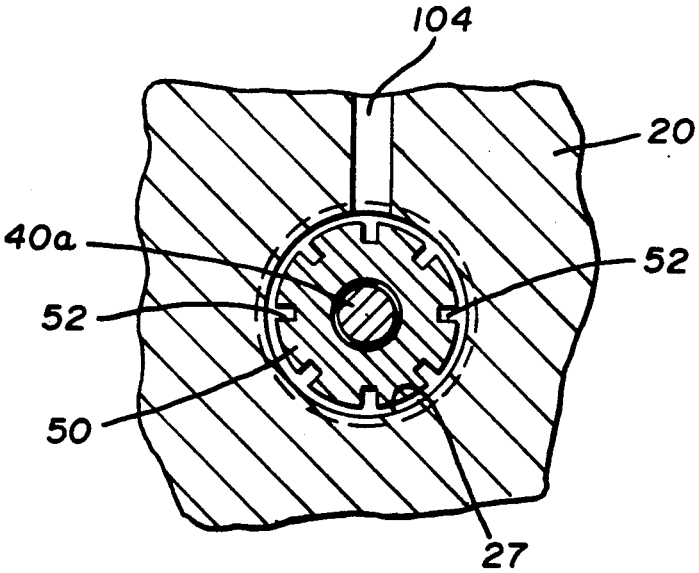
FIG. 4 is a sectional view taken along the line 4—4 of FIG. 3.
Figure 5:
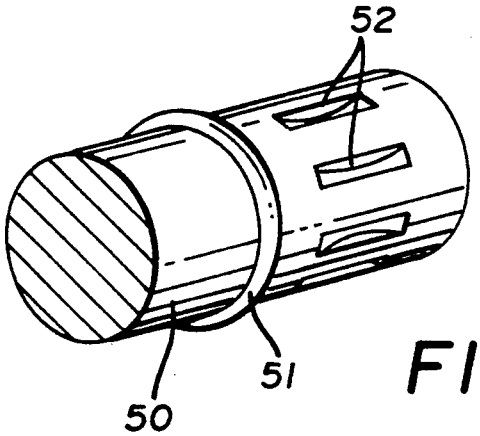
FIG. 5 is a perspective view of the improved pilot valve taken along the line 5—5 of FIG. 4.
Figure 6:
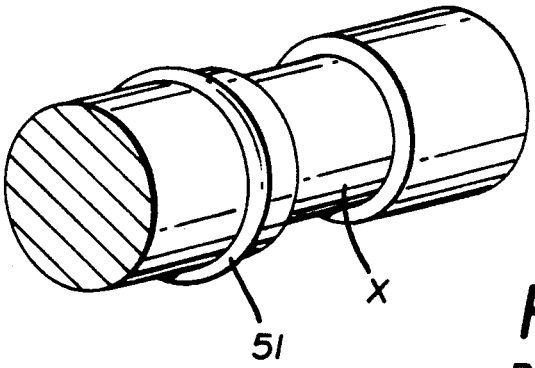
FIG. 6 PRIOR ART
FIG. 6 is a perspective view of a prior art pilot valve.

FIGS. 4 and 5 of the drawings also illustrate the narrow axial grooves 52 in pilot valve 50 so that air may pass from passages 103 and 104 to exhaust passage 80. FIG. 6 illustrates a prior art pilot valve having a full annular groove X for this purpose. The difficulty is that, as can be appreciated, the usual O-ring 51 will tend to drop into such grooves. Significant force would be required to force O-ring 51 out of a full annular recess X as shown in the prior art of FIG. 6 when the valve moves. Under low speed, low pressure operation, the connecting rod 40 may not develop sufficient force to accomplish this, using the full annular recess of the prior art. However, by utilizing axially extending recesses 52, the force required is minimized and nearly constant, thereby further assuring that the motion is uninterrupted.

Figure 7:
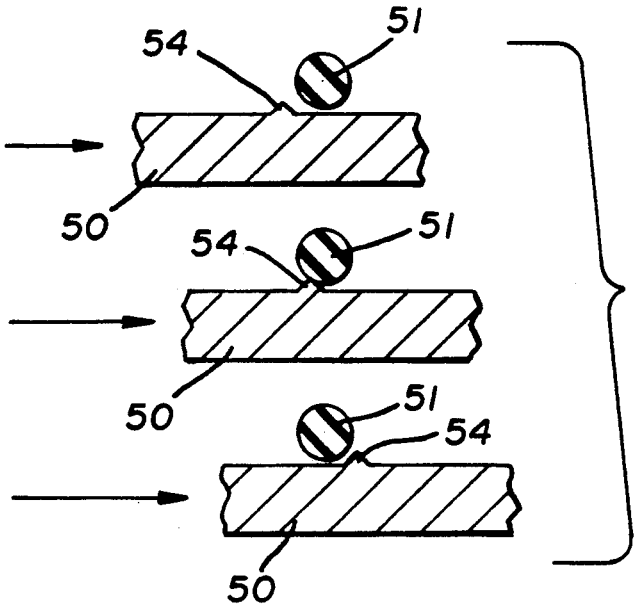
FIG. 7 is a schematic depiction of the operation of projection 54 to facilitate low speed movement.

To further insure this, as can be seen in FIG. 3 and schematically in FIG. 7, as the pilot valve 50 moves, the projection 54 engages an O-ring as the valve moves and would appear to tend to stop movement. However, pressure builds in first or second pressure chamber 21 or 22, depending on the direction of movement, until it becomes great enough that the projection must go one way or the other, and it effectively "jumps" the O-ring and movement of the pilot valve continues. The schematic view of FIG. 7 illustrates how, as the valve 50 moves to the right, the projection 54 engages and compresses O-ring 51 until pressure in pressure chamber 22 exceeds that required to pump the liquid at which time projection 54 jumps past the O-ring. It will be noted that the function of projection 54 is only a factor at very low speeds but that, in that situation, continuous operation is insured.

While a full and complete description of the invention has been set forth in accordance with the dictates of the Patent Statutes, it should be understood that modifications can be resorted to without departing from the spirit hereof or the scope of the appended claims.

What is claimed is:

1. In a double diaphragm pump having a body divided into opposed pumping chambers and opposed pressure chambers separated from the pumping chambers by opposed flexible diaphragms, the improvement comprising:

a) an elongate shaft carried by the body for axial movement relative thereto and having its opposed ends connected to the opposed flexible diaphragms;

b) a pilot valve sleeve telescoped over said elongate shaft for selected engagement with and axial movement relative to said shaft and with said shaft;

c) a spool valve assembly carried by the body for axial movement relatively thereof;

d) the body having a spool valve cavity for receipt of said spool valve and a pilt valve cavity for receipt of said pilot valve sleeve;

e) said spool valve cavity being in selected fluid communication with said pilot valve cavity, the atmosphere and the opposed pressure chambers; and f) said pilot valve cavity being in selected fluid communication with the atmosphere and said spool valve cavity.

2. The pump of claim 1 wherein said pilot valve sleeve has at least one axially extending recess disposed on its periphery.

3. The pump of claim 1 or 2 wherein said pilot valve sleeve has an inwardly projecting circumferential ring disposed adjacent its axial midpoint.

4. The pump of claim 3 wherein said elongate shaft has an inwardly extending annular recess located adjacent its axial center and forming opposed shoulders for selective engagement with said rib upon axial movement of said elongate shaft.

5. The pump of claim 3 wherein said pilot valve sleeve has a projecting annular rib disposed about its periphery between its axial center and one end thereof.

6. The pump of claim 3 wherein said elongate shaft includes first and second elongate body portions releasably interconnected to each other.

7. The pump of claim 6 wherein each of said body portions has a first diameter portion; at least one of said body portions has a reduced diameter portion; said reduced diameter portion of said at least one body portion serving to interconnect said first and second body portions and space said first diameter portions from each other to form an inwardly extending annular recess.

8. The pump of claim 5 wherein one or more resilient sealing members are disposed on the inner surface of said pilot valve cavity; said projecting annular rib engaging and compressing at least one of said sealing members upon axial movement of said elongate shaft.

9. The pump of claim 1 wherein said spool valve assembly includes an elongate spool valve having a body and a central annular rib extending therefrom; and a slide valve receivable within said spool valve cavity and engagable with said rib of said spool valve.

10. The pump of claim 1 wherein said body includes a main supply passageway communicating with said spool valve cavity; first and second pressure chamber supply passageways communicating with said first and second pressure chambers and said spool valve cavity; and a first exhaust passage communicating with the atmosphere and said spool valve cavity.

11. The pump of claim 1 wherein said body includes first and second pilot valve passageways communicating with said spool valve cavity and said pilot valve cavity; and a second exhaust passageway communicating with said pilot valve cavity and the atmosphere.

12. In a double diaphragm pump having a body divided into opposed pumping chambers and opposed pressure chambers separated from the pumping chambers by opposed flexible diaphragms, the improvement comprising:

a) an elongate shaft carried by the body for axial movement relative thereto and having its opposed ends connected to the opposed flexible diaphragms;

b) a pilot valve sleeve telescoped over said elongate shaft for selected axial movement relative to said shaft and with said shaft;

c) a spool valve assembly carried by the body for axial movement relatively thereof;

d) the body having a spool valve cavity for receipt of said spool valve and a pilot valve cavity for receipt of said pilot valve sleeve;

e) said spool valve cavity being in selected fluid communication with said pilot valve cavity, the atmosphere and the opposed pressure chambers;

f) said pilot valve cavity being in selected fluid communication with the atmosphere and said spool valve cavity; and g) said pilot valve sleeve having an inwardly projecting circumferential ring disposed adjacent its axial midpoint.

13. The pump of claim 12 wherein said elongate shaft has an inwardly extending annular recess located adjacent its axial center and forming opposed shoulders for selective engagement with said rib upon axial movement of said elongate shaft.

14. The pump of claim 12 wherein said pilot valve sleeve has a projecting annular rib disposed about its periphery between its axial center and one end thereof.

15. The pump of claim 14 wherein one or more resilient sealing members are disposed on the inner surface of said pilot valve cavity; said projecting annular rib engaging and compressing at least one of said sealing members upon axial movement of said elongate shaft.

16. The pump of claim 12 wherein said elongate shaft includes first and second elongate body portions releasably interconnected to each other.

17. The pump of claim 16 wherein each of said body portions has a first diameter portion; at least one of said body portions has a reduced diameter portion; said reduced diameter portion of said at least one body portion serving to interconnect said first and second body portions and space said first diameter portions from each other to form an inwardly extending annular recess.

* * * * *

UNITED STATES PATENT AND TRADEMARK OFFICE

CERTIFICATE OF CORRECTION

PATENT NO. : 5,232,352

DATED : August 3, 1993

INVENTOR(S) : Ronald L. Robinson

It is certified that error appears in the above-identified patent and that said Letters Patent is hereby corrected as shown below:

In Column 5, line 41, delete "pilt" and substitute therefor ---pilot---.

Signed and Sealed this

Fifteenth Day of March, 1994

*Attest:*

Bruce Lehman

BRUCE LEHMAN

*Attesting Officer*

*Commissioner of Patents and Trademarks*